United States Patent [19]

Williamson

[11] Patent Number: 4,467,772

[45] Date of Patent: Aug. 28, 1984

[54] MODULAR BARREL FUEL INJECTION APPARATUS

[76] Inventor: Charles A. Williamson, 602 Callè de Arboles, Torrance, Calif. 90505

[21] Appl. No.: 367,903

[22] Filed: Apr. 13, 1982

[51] Int. Cl.[3] ..... F02M 59/42

[52] U.S. Cl. ..... 123/506; 123/501; 239/95; 419/2

[58] Field of Search ..... 239/533.2–533.12, 239/88, 89, 90, 91, 92, 93, 94, 95, 600, 132.5; 29/156.7 R, 156.4 R; 123/198 DB, 500, 501, 502, 495, 51, 506; 419/2, 28, 38, 6; 428/550, 566

[56] References Cited

U.S. PATENT DOCUMENTS

| | | | |
|---|---|---|---|
| 1,079,578 | 11/1913 | Peterson | 239/95 |
| 1,875,457 | 9/1932 | Hemmingsen | 239/132.5 |
| 2,227,307 | 12/1940 | Hildabolt | 419/2 |
| 2,519,683 | 8/1950 | Marien | 428/550 |
| 2,695,231 | 11/1954 | Causley | 419/2 |
| 2,696,434 | 12/1954 | Bartlett | 419/2 |
| 3,351,288 | 12/1967 | Perr | 239/90 |
| 3,409,225 | 11/1968 | Maddalozzo | 239/95 |
| 4,055,615 | 10/1977 | Ikeda | 419/28 |
| 4,306,681 | 12/1981 | Laito | 239/533.3 |
| 4,369,750 | 1/1983 | Muntean | 239/90 |

*Primary Examiner*—Charles J. Myhre
*Assistant Examiner*—Carl Stuart Miller
*Attorney, Agent, or Firm*—Browdy & Neimark

[57] ABSTRACT

A fuel injector valve assembly primarily for use with a diesel engine, including an improved barrel unit comprising an annular, generally cylindrical body having a plurality of internally-disposed, transversely and longitudinally-arranged passageways for the flow of fuel therein. The internal fuel passageways and ports are substantially rectangular rather than round. As a result, the injector operates at lower temperatures. A positive correlation has been discovered between lower injector temperatures in a diesel engine and lower exhaust smoke emission. A positive correlation has been discovered between lower injector temperature and better fuel economy and better horsepower output.

3 Claims, 5 Drawing Figures

(TOP VIEW)

(BOTTOM VIEW)

(TOP VIEW)

(BOTTOM VIEW)

(TOP VIEW)

(BOTTOM VIEW)

MODULAR BARREL FUEL INJECTION APPARATUS

CROSS-REFERENCE TO RELATED APPLICATIONS

The present invention is a modification of my "Improved Fuel Injection Apparatus for Internal Combustion Engines" disclosed and claimed in application Ser. No. 829,879 filed Sept. 1, 1977, now abandoned.

BACKGROUND OF THE INVENTION

1. Field of the Invention

The field of the invention is diesel engine injectors.

2. Description of the Prior Art

Prior to the present invention the use of diesel engine injectors was known. One type of diesel engine injector is the Cummins Diesel Engine Injector type "D" and "K" fuel injector.

Fuel injectors similar to that of Cummins utilize a plunger, an injector body, a nut, and a barrel. The barrel in the prior art comprises an annular, generally cylindrical body having a plurality of internally-disposed, transversely and longitudinally-arranged passageways for the flow of fuel therein. The prior art barrels of this type have fuel passageways which are circular, because they are drilled into a blank. The presence of circular passageways inside the blank permits fuel to flow in a fuel circuit and the presence of ports in the barrel enable the plunger to meter a specific amount of fuel and to inject that fuel into the combustion chamber of the diesel engine.

A major object of the present invention is to provide for substantially rectangular fuel passageways throughout the barrel, and to provide for substantially rectangular ports. The inventor noticed that by having more fuel flow from the scavenging port to the spill port the barrel and the plunger and nearby parts operate at a remarkably lower temperature. In order to obtain higher fuel flow through the constricted area of the barrel, the inventor has conceived of the use of rectangular ports and rectangular internal passageways to permit that increased flow.

Another object of the invention is to obtain smoother wall surfaces to decrease fluid friction resistance to the flow of fuel through the injector assembly.

Another object of the invention is to reduce exhaust smoke emissions, to obtain better fuel operating economy, and to obtain more horsepower at a lower rpm.

SUMMARY OF THE INVENTION

The present invention is an improved fuel injector valve assembly primarily for use with diesel engine fuel injectors similar to that of a Cummins diesel engine employing type "D" and "K" fuel injectors. The structural changes disclosed herein are found in the barrel unit of the fuel injector. The invention is also found in the fluid circuit concept wherein the flow of fuel into the injector assembly and back to the fuel tank is substantially increased and thereby the temperature of the fuel injector is lowered, and as an unexpected result the exhaust smoke emissions are reduced dramatically (laboratory tests indicate a 30% reduction of smoke), and the unexpected result of higher horsepower and better torque output at a lower range of rpm's.

The invention is also found in a unique approach to manufacturing the barrel unit. Instead of manufacturing the barrel unit on a screw machine in one piece from one blank of metal, the invention includes a method of manufacture wherein powdered metal is formed in three separate portions of the barrel unit. Each of the three portions of the barrel unit is formed in its own die and at that time internal square or rectangular passages are formed in the powdered metal form. After the powdered metal is squeezed in the die, it is called "green" and the "green" metal form is then sintered at red hot temperatures at which time it becomes a hard piece of metal. Part of the unique process is to coin the green powdered metal form while it is at red heat temperature.

Because the barrel unit consists of three pieces, the three pieces are then assembled and welded into one piece.

The result of the manufacturing method described above is that substantially rectangular fuel passageways and fuel ports can be formed within a metal structure which metal structure can then be utilized in the tens of thousands of existing diesel engines which utilize standard-sized barrel units in their diesel engine injectors.

Because there are tens of thousands of diesel engines which presently have standard-sized barrel units as part of their diesel engine injectors, it is not practical to replace the entire engine or the entire injector body in order to make larger fuel ports in the existing injector assembly. Therefore, it is impractical to take advantage of the discoveries of the inventor that lower injector temperatures result in dramatically lower exhaust smoke and significantly better fuel economy and better horsepower output and better torque output, unless more fuel could be caused to flow through the barrel units. The invention solves the problem of retro-fitting those tens of thousands of diesel engines by utilizing a barrel unit which has the same outside dimensions as barrel units which are standard in the industry and then obtaining higher fuel flow through the barrel unit by means of rectangular ports in place of circular fuel ports and by utilizing rectangular passageways instead of circular passageways. As was described above, the method of manufacturing also leads to the result that the walls of the fuel passages and ports are significantly smoother than those formed by machining and drilling, which is the present practice in the industry. The smoothness of the inventor's barrel unit results in less friction resistance to the flow of fuel. Because the walls are smoother, the friction is less, and therefore more fuel can pass through the barrel unit, particularly from the "scavenging port" to the "spill port" and exit the injector. The increase in fuel flow carries away with it more of the heat of the injector. The heat of the injector has two sources, the first from the combustion chamber where the burning air and diesel fuel mixture produces tremendous heat, the second, is from the friction and compressional heating due to the action of the plunger sliding in the injector body.

DESCRIPTION OF THE PREFERRED EMBODIMENT

Figure 1:
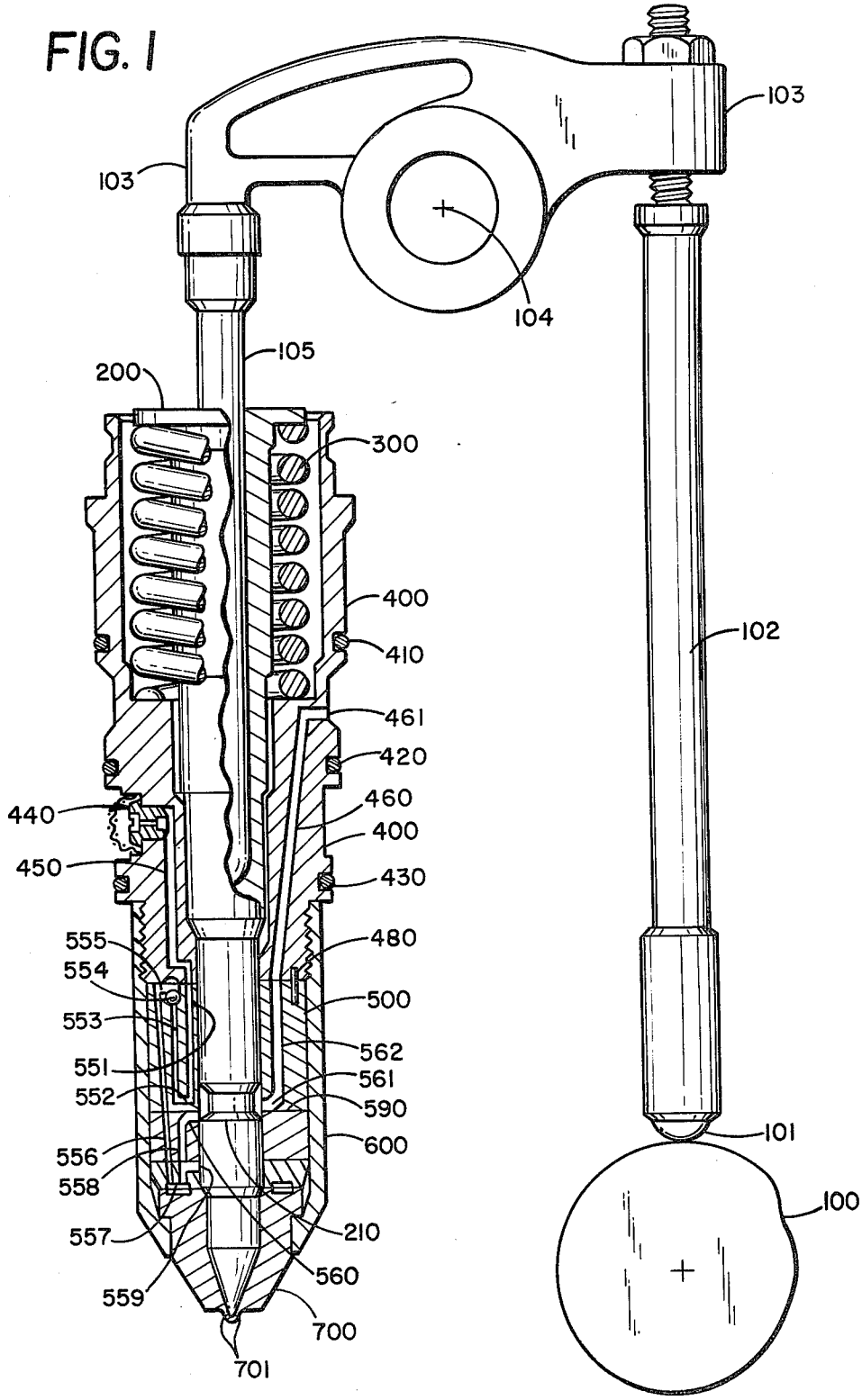
FIG. 1 is a cross-section showing a fuel injector valve assembly similar to that found in a Cummins Diesel Engine employing type "D" and "K" fuel injectors.

A cam 100 is shown in FIG. 1, in rotating contact with cam follower 101, and connecting rod 102. Connecting rod 102 is attached to and operates on rocker arm 103 which in turn is attached to and operates on plunger 200 and rod 105.

Plunger 200 operates in a reciprocating fashion and is biased by spring 300. Spring 300 and a major portion of the plunger 200 is housed within the injector valve body 400. The injector valve body is mounted in a diesel engine, not shown.

The injector valve body 400 has mounted in axial alignment with it barrel unit 500 and a cover nut 600, and a nozzel unit 700.

"O" rings located at 410, 420, 430 provide for fluid-tight connections between the injector body 400 and the diesel engine not shown.

Fuel under high pressure enters at adjustment screw 440, and passes through passageway 450 to the barrel unit 500.

Barrel unit 500, in fact, consists of three cylindrical bodies 510, 520, and 530, corresponding to the top, middle, and bottom portions of barrel unit 500. Barrel unit 500 is an axially aligned assembly of 510, 520, and 530, which parts are welded together.

A more detailed description of the flow of the fuel and the internal channels of barrel unit 500 is shown below.

Figure 3:
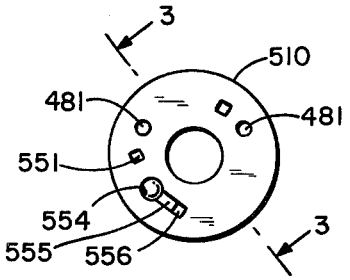
FIG. 3 shows views of the top, bottom, and a sectional view taken along the lines 3—3 of one portion of the barrel unit.
Figure 3:
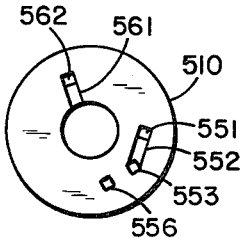
Figure 3:
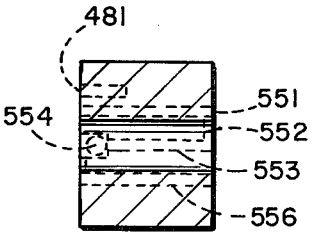

Locating pins 480 align the barrel unit 500 and the injector body 400 and provide for circular alignment of fuel passage 450 and fuel passage 551 in the barrel. With reference to FIG. 3, fuel passage 551 in the barrel is shown at the top portion of the barrel unit shown in perspective.

Fuel passage slot 552 is shown in FIG. 1, and again in the bottom view of FIG. 3. That slot provides for communication of the fuel from fuel passageway in the barrel 551 over to ball valve fuel passageway 553 in the barrel. Ball valve fuel passageway 553 is shown in FIG. 1, and again in the top, bottom, and sectional views in FIG. 3.

A substantially spherical ball 554 is seated above the fuel passageway 553, and said ball 554 operates as a one-way check valve.

Ball valve slot 555 provides for communication of fuel from the fuel passageway 553 over to fuel passageway 556, which extends the entire length of the barrel unit 500. Fuel passageway 556 is shown in all views of FIGS. 3, 4, and FIG. 5. Generally, high pressure fuel passes through the ball check valve 554 and all the way down through the barrel unit to circular channel 557. Fuel in circular channel 557 accumulates heat present in nozzle 700 and barrel unit 500. Circular channel 557 is shown in the bottom view of FIG. 5. With reference to the bottom view of FIG. 5, fuel flows from 556 into the circular channel 557, and flows in two directions around the circular channel to the fuel passage 558.

Figure 4:
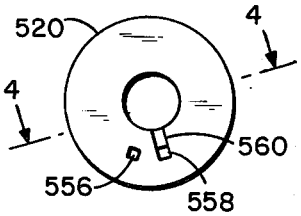
FIG. 4 is a view of the top, a view of the bottom, and a sectional view taken along the lines 4—4 of the middle portion of the barrel unit.
Figure 4:
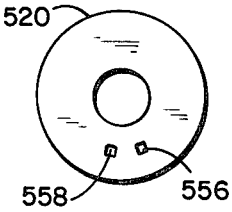
Figure 4:
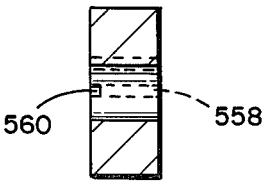
Figure 5:
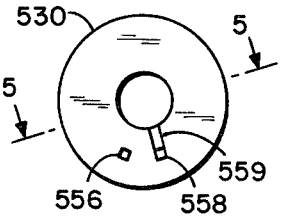
FIG. 5 is a view of the top, a view of the bottom, and a sectional view taken along the lines 5—5 of the lower portion of the barrel unit.
Figure 5:
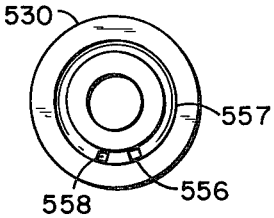
Figure 5:
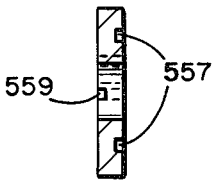

Fuel passage 558 is shown in FIG. 1, and again in all views of FIG. 4, and all views of FIG. 5.

Fuel from fuel passageway 558 passes by means of fuel metering slot 559 into that portion of the fuel injector from which the metered fuel is moved into position in nozzle 700 to be sprayed through holes 701 into the diesel engine combustion chamber.

Some of the fuel from fuel passageway 558 passes through the scavenger slot port 560 from which position it moves around one portion of the plunger 200 and across to spill port slot 561. The scavenger slot port 560 is shown in the top view of FIG. 4, and in the sectional view of FIG. 4. The scavenger slot port 560 is shown in the bottom view of FIG. 3.

Figure 2:
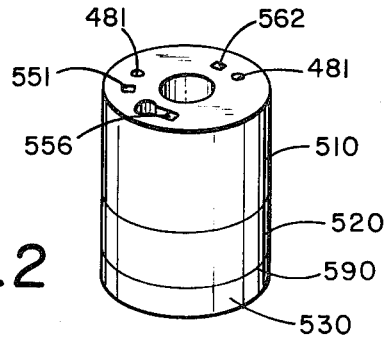
FIG. 2 is a perspective view of the barrel unit which is found in the injector valve assembly.

Fuel which passes through spill slot port 561 passes vertically through fuel passageway 562 as shown in all views of FIG. 3, and in the perspective view of FIG. 2, and in the sectional view of FIG. 1.

Fuel outlet passageway 460 permits fuel to flow from fuel passageway 562 out through 460 to the fuel outlet 461. Fuel outlet 461 is in communication with the fuel tank of the diesel engine, not shown, where the fuel cools.

In summary, the fuel circuit includes fuel inlet 440, the various passageways within the injector assembly, and fuel outlet 461. In the invention, a major portion of the fuel entering through the fuel inlet 440 will be expelled from fuel outlet 461, and only a minor portion of the fuel entering through fuel inlet 440 will be expelled through the fuel nozzle 700 and fuel spray holes 701.

The result is that the heat which is generated within the injector assembly due to the reciprocating action of the plunger 200 and springs 300, as well as the heat which is communicated to the injector assembly by heat transfer to the nozzle 700 and other parts of the assembly from the combustion chamber, is carried away primarily by the fuel exiting the injector at fuel outlet 461.

Focusing on the plunger 200, the plunger as shown, is part of the prior art. The plunger is pushed upwards as shown in FIG. 1, by the spring 300, and it is biased downward by rocker arm 103. Focusing on the nozzle 700 as shown in FIG. 1, when the plunger moves upward, a chamber is formed between the inner surfaces of the nozzle body 700 and the pointed portion of plunger 200. Fuel from the fuel metering slot 559 flows into that space created by the upward movement of plunger 200 and by the inner walls of nozzle 700, and when plunger 200 moves down, the fuel metering slot 559 is cut off from the fuel which has moved into the region near the inner wall of nozzle 700 and the pointed portion of plunger 200. The fuel in that region has no place to go except to move through the holes in the lower tip of nozzle 700. From those holes 701, the fuel is sprayed into the combustion chamber of the diesel engine.

As the plunger moves down towards nozzle 700, scavenger slotted port 560 and that portion of the plunger 200 shown as 210 interact to permit the flow of fuel from port 560 around portion 210 and out slotted spill port 561.

Unlike the prior art, the preferred embodiment of this invention calls for the axial alignment of slotted scavenger port 560 with slotted spill port 561. As shown in FIGS. 1, 3 and 4, slotted scavenger port 560 is formed by a slot in the top portion of the barrel unit 530 and the lower face of the middle portion 520 of barrel unit 500.

As shown in FIGS. 1, 3 and 4, slotted spill port 561 is formed by a slot in the lower face of the middle portion 520 of barrel unit 500, and the top face of middle portion 530 of barrel 500. Thus both the scavenger port 560 and the spill port 561 have a common parting line 590.

The prior art utilizes a scavenger port and a spill port separated by a substantial distance along the axis of the plunger 200. The prior art designs are believed to be intended to restrict the flow and reduce the flow of fuel from the port 560 across to port 561. The present invention teaches just the opposite. The placement of ports 560 and 561 in close axial alignment promotes the increased flow of fuel and thus further promotes the cooling factor desired by the present invention.

While only a preferred embodiment of the invention has been disclosed, it will be readily apparent that certain variations in the same can be made without departing from the spirit of the invention, and it is, therefore, to be understood that the invention is not to be limited to the same, but only by the scope of the appended claims.

Having now described the invention, what is claimed as new and sought to being protected by Letters Patent of the United States of America, is:

1. A fuel injector for an internal combustion engine of the type comprising a barrel unit, and nozzle means positioned at one end of said barrel unit in axial alignment therewith, a housing positioned at the other end of said barrel unit in axial alignment therewith; a cover nut removably holding said housing, said barrel unit and said nozzle means in assembled together relationship; means to movably mount a fuel flow control plunger in said assemblage of said housing, said barrel unit and said nozzle means in liquid-tight sliding relationship with said housing, said barrel unit, and said nozzle means; said barrel unit comprising three segments fixed together in axially aligned relationship, fuel supply passageway means and fuel return passageway means formed in said assemblage of said housing, said barrel unit and said nozzle means; said fuel supply passageway means formed in said barrel unit comprising a metering port formed in said barrel unit for cooperation with said plunger; said fuel return passageway means formed in said barrel unit comprising a scavenging port formed in said barrel unit for cooperation with said plunger; said fuel return passageway means formed in said barrel unit comprising a spill port formed in said barrel unit for cooperation with said plunger; said metering, scavenging and spill ports all being of substantially rectangular configuration; at least the portions of said fuel supply and said fuel return passageway means opening into said metering, scavenging and spill ports all being of substantially rectangular configuration; the dimensions of said metering, scavenging and spill ports being such as to permit return fuel flow away from the injector to be increased compared to return fuel flow in barrel units having corresponding circular ports, whereby the injector is cooled due to the increased return fuel flow to result in reduced exhaust emissions, increased horsepower, increased torque, and increased fuel economy; said barrel unit segments comprising sintered powder metal of controlled porosity, whereby the fuel impregnates the interstices of the metal grains of each segment and whereby self-lubrication of the close sliding fit between said plunger and said barrel unit produces lower friction, less internal heat generation in the fuel injector and thereby produces reduced exhaust smoke emissions and said improved engine performance; and the scavenging port and the spill port being located in substantially the same plane in said barrel unit to thus share substantially the same parting line between two of said three segments of said barrel unit, whereby a fuel injector is provided which can be retrofitted in place of a conventional injector due to its having interchangeable external dimensions while at the same time a greatly increased return fuel flow is provided as compared to that of the conventional injector.

2. The fuel injector of claim 8, wherein said supply and return fuel passageway means are both substantially rectangular in cross-section.

3. The fuel injector of claim 1, and slot means formed in the contacting faces of the segments of said barrel unit, said slot means forming part of said fuel supply and return passageway means.

* * * * *